US009309041B2

(12) United States Patent
Mabee et al.

(10) Patent No.: US 9,309,041 B2
(45) Date of Patent: Apr. 12, 2016

(54) CONTAINER FITMENT HAVING ELLIPSOIDAL OPENING

(75) Inventors: Michael S. Mabee, Mason, OH (US); Christopher M. Roeder, Memphis, TN (US)

(73) Assignee: Evergreen Packaging Inc., Memphis, TN (US)

( * ) Notice: Subject to any disclaimer, the term of this patent is extended or adjusted under 35 U.S.C. 154(b) by 0 days.

(21) Appl. No.: 13/550,483

(22) Filed: Jul. 16, 2012

(65) Prior Publication Data

US 2013/0092713 A1 Apr. 18, 2013

Related U.S. Application Data

(63) Continuation of application No. 10/804,933, filed on Mar. 18, 2004, now abandoned.

(51) Int. Cl.

| | |
|---|---|
| ***B65D 47/10*** | (2006.01) |
| ***B65D 83/00*** | (2006.01) |
| ***B65D 5/74*** | (2006.01) |
| ***B65D 47/08*** | (2006.01) |

(52) U.S. Cl.

CPC ..... *B65D 83/00* (2013.01); *B65D 5/746* (2013.01); *B65D 47/0814* (2013.01); *B65D 47/103* (2013.01)

(58) Field of Classification Search

CPC ..... B65D 47/103; B65D 17/163; B65D 2517/0013; B65D 47/0814; B65D 83/00; B65D 5/746

USPC ..... 222/481, 488, 541.5, 570, 572, 575, 222/556, 541.6, 541.9; 220/254.3, 255.1, 220/259.1, 258.2, 270, 276, 266, 265; 215/235–237; 229/125.04, 125.05, 229/125.14, 125.15; D9/449

See application file for complete search history.

(56) References Cited

U.S. PATENT DOCUMENTS

| | | | | |
|---|---|---|---|---|
| 3,142,422 | A * | 7/1964 | Mojonnier | 222/566 |
| 3,278,089 | A * | 10/1966 | Heekin et al. | 222/153.07 |
| 3,434,620 | A * | 3/1969 | Laurizio | 220/258.2 |
| 4,934,590 | A * | 6/1990 | Robichaud et al. | 229/125.09 |
| 5,065,938 | A * | 11/1991 | Anderson | 229/125.08 |
| 5,381,935 | A * | 1/1995 | Mock | 222/541.5 |
| 5,484,101 | A * | 1/1996 | Hedberg | 229/125.04 |
| 5,499,736 | A * | 3/1996 | Kohl | 220/254.5 |
| 5,632,440 | A * | 5/1997 | Tragardh et al. | 229/125.15 |
| 5,735,426 | A * | 4/1998 | Babcock et al. | 220/258.2 |
| 6,575,330 | B2 * | 6/2003 | Rousselet | 222/1 |
| 7,387,220 | B2 * | 6/2008 | Verespej et al. | 222/153.01 |
| 7,559,432 | B2 * | 7/2009 | Mavin | B65D 47/103 215/256 |
| 2002/0108922 | A1 * | 8/2002 | Hierzer | B65D 47/0814 215/235 |

* cited by examiner

*Primary Examiner* — Nicholas J Weiss

(74) *Attorney, Agent, or Firm* — Perkins Coie LLP

(57) ABSTRACT

A fitment for use in the discharge of pourable contents from a container wherein the constancy of uniform flow of contents from the container is minimally, if at all, adversely affected by the need for accommodating inflow of ambient air into the container as the contents are discharged from the container, the fitment including a conduit an exit end having an ellipsoidal cross-sectional geometry including a minor portion and an major portion, the geometry of the conduit exit being oriented uppermost toward (topwise of) the top end of the container. A method is disclosed.

15 Claims, 9 Drawing Sheets

CONTAINER FITMENT HAVING ELLIPSOIDAL OPENING

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to fitments (pour spouts) for containers, particularly paperboard containers, useful for the discharge of pourable substances from the container and for selectively closing and sealing the container against the discharge of its contents.

BACKGROUND OF INVENTION

Containers for pourable substances, such as juices, milk, etc. commonly include a pouring spout, commonly called a fitment in the industry, which is associated with the top end of the container. Desirably, such pour spout is mounted in covering relationship to an opening defined through the thickness of the top end of the container, includes a tamper evident component and a cap for selectively reclosing the spout for storage of contents remaining in the container.

Paperboard is a common material used in the manufacture of containers for pourable substances. Closures for the top end of many paperboard containers include the well-known gable top type end closure wherein the top end of the container includes at least two flat panels which rise at acute angles toward each other from opposite side panels of the container and have their distal edges joined together in the form of a fin which extends across the width of the container.

Heretofore it has been common to define an opening through one of the top flat panels and mount a pour spout in covering relationship to the opening to define a conduit through which the contents of the container may be poured from the container.

Desirably, the fitment is also provided with a tamper evident component.

U.S. Pat. Nos. 5,133,486; 5,735,426 and 6,390,342 disclose fitments which include an integrally formed tear-away membrane which seals a conduit defined by the fitment until the membrane is pulled away, as by a finger ring, to initially open the conduit for the flow of the container contents therethrough. This tear-away membrane provides tamper evident protection for the contents of the container. Further, caps used to reclose the conduit for storage of unused contents of the container are disclosed in these patents. These fitments are of the two-piece variety in that the cap is neither integrally formed with nor otherwise attached to the fitment or container.

U.S. Pat. Nos. 3,135,441; 3,239,112; 3,458,080. and 4,022,357 disclose fitments of a one-piece variety wherein the reclosable cap of the fitment is integral with the fitment. These fitments are of the one-piece variety.

All known fitments of the prior art employ a true circular opening defined through the wall thickness of the container, usually through a panel which is a part of the top end closure of the container. Further, the known prior art fitments define a true cylindrical conduit for the discharge of the contents of the container. Such conduit establishes a flow path of a finite length along which the contents of the container must flow as they exit the container. This flow path further provides the only path for the entry of ambient air into the container to replace the outgoing volume of pourable substance and thereby avoid the development of a vacuum within the container as the outpouring of contents proceeds. Most commonly when the contents of the container are being discharged through the conduit, the outgoing substance, commonly a liquid, fully fills the conduit and blocks the inflow of replacement air until such time as the vacuum developed inside the container overcomes the outflow of contents. Thereupon, there is a sudden rush of air into the container and a concomitant dramatic fluctuation in the rate of outflow of the container contents. This action is likened to a burp and dramatically disrupts the desired continuity of the outflow of the contents from the container. Much splatter of the contents may occur and/or spillage of the contents outside a receptacle provided for the receipt of the outflowing contents. One effort to avoid this undesirable situation has been to insert a separate air intake tube leading from outside to the interior of the container. Manufacture of fitments with such tubes is difficult and costly. Further, placement of the inboard end of the tube such that the tube itself does not become filled with contents from the container, and thereby fail as an air intake to the container, has not successfully been solved in the prior art. In some instances, the rate of discharge of the contents from the container greatly exceeds the flow capacity of the air infeed tube, thereby defeating the purpose of the tube. Larger tubes detract from the area of the conduit exit through which the contents of the container can flow, thereby causing the outflow of the contents to be undesirably slow.

SUMMARY OF INVENTION

In accordance with the present invention, there is provided a fitment for use in the discharge of pourable contents from a container wherein the constancy of uniform flow of contents from the container is minimally, if at all, adversely affected by the need for accommodating inflow of ambient air into the container as the contents are discharged from the container through a conduit defined by the fitment. This constancy of uniform flow of contents is effected by forming at least the exit end of the conduit with an ellipsoidal cross-sectional geometry including a minor portion and a major portion wherein the minor portion of the ellipsoidal geometry of the conduit exit is oriented vertically uppermost toward (topwise of) the top end of the upright container. By this orientation of the fitment, the contents of the container exit via the major portion of the conduit exit end geometry while ambient air simultaneously enters the container via the minor portion of the conduit geometry.

Preferably the present fitment includes a tear-away membrane disposed within the conduit and is substantially the same as the cross-sectional geometry of the conduit at the location of the membrane such that the perimeter of the membrane is initially bonded to the inner wall of the conduit to close the conduit.

In accordance with one aspect of the present invention, the point of initiation of the tearing away of the membrane of the present fitment preferably is selected to be associated with the minor portion of the opening. Thus, force required for initiation of the tearing away of the membrane is minimized and only gradually increases as the membrane is further torn away from the wall of the conduit, thereby enhancing the uniformity of tearing away of the membrane.

The fitment of the present invention further includes a reclosable cap component which is integrally hinged to the outboard rim of the conduit wall to define a fitment of the one-piece variety.

DETAILED DESCRIPTION OF INVENTION

Figure 1:
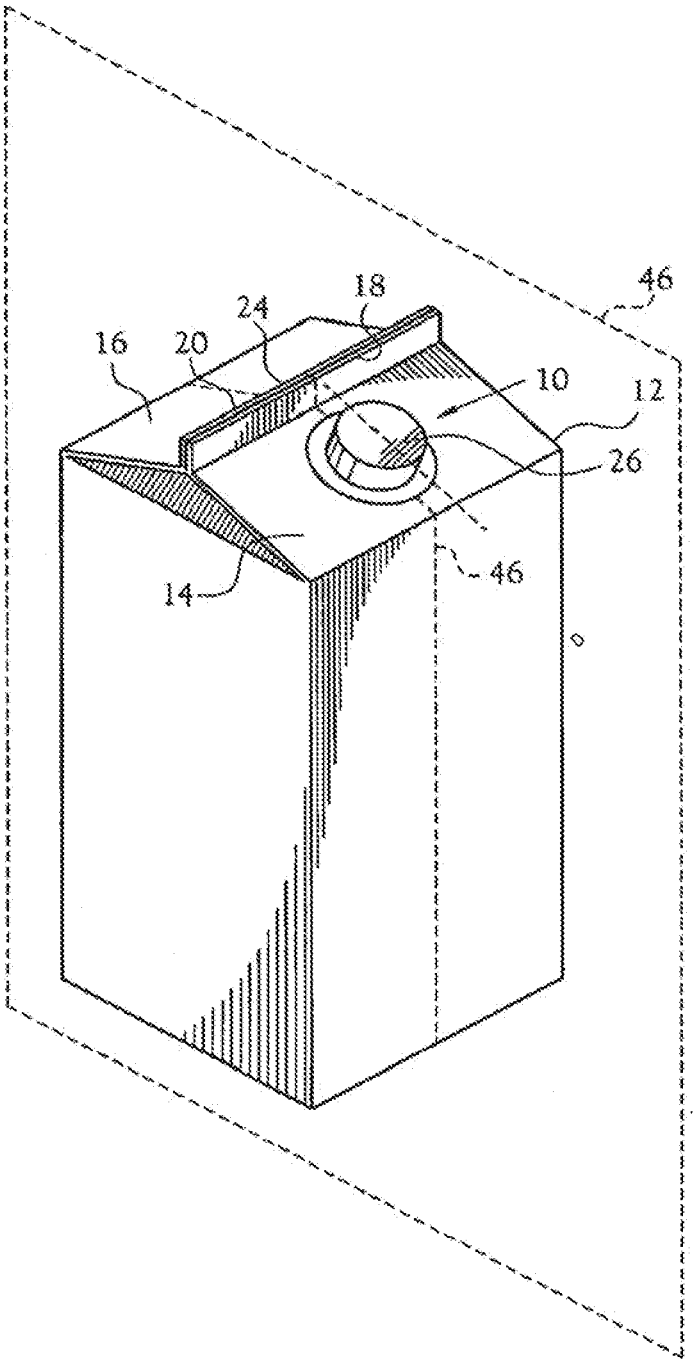
Fig. 1 (Prior Art)
FIG. 1 is a schematic representation of a prior art gable top container having a prior art fitment affixed to a top panel of the gable top.

FIG. 1 depicts a prior art gable top type paperboard container 10. The top end 12 of the container is closed as by multiple panels folded inwardly of the center of the container to define first and second lateral inclined panels 14 and 16 (among others) having their distal edges 18 and 20 bonded together to define a fin 24. The depicted container includes an opening 58 (See FIG. 7) through the thickness of the top panel 14 and a fitment 26 affixed to the panel in overlying and covering relationship to the opening, thereby providing a means for the dispensing of the contents of the container out through the fitment. Other containers having pour spouts affixed to the top end of a side wall of the container have been proposed. Further, the prior art includes containers having pour spouts associated with a flat top end of the container. The present fitment is also useful in these and other containers.

Figure 2:
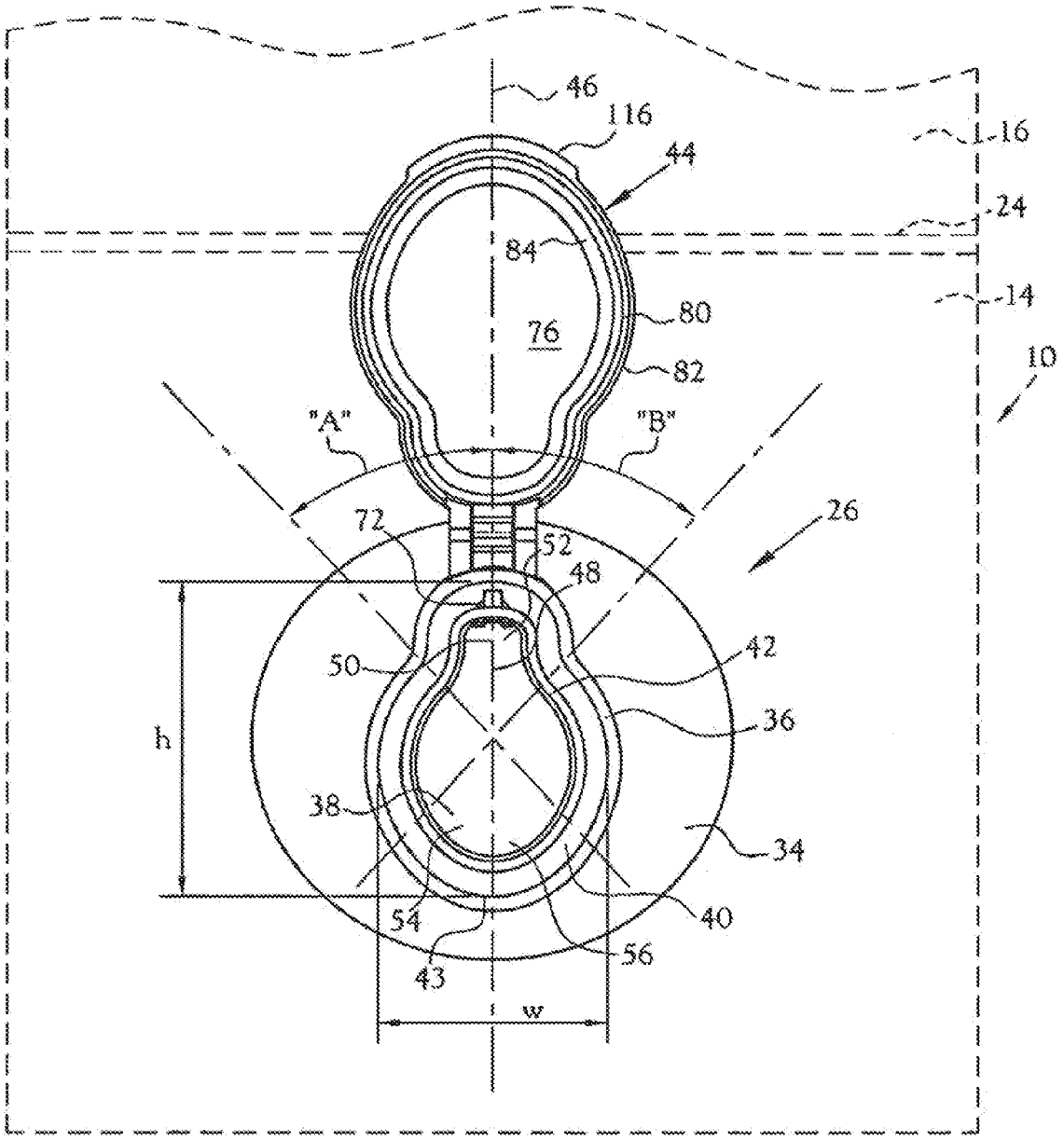
FIG. 2 is a top plan view of one embodiment of a fitment depicting various of the features of the present invention.
Figure 4:
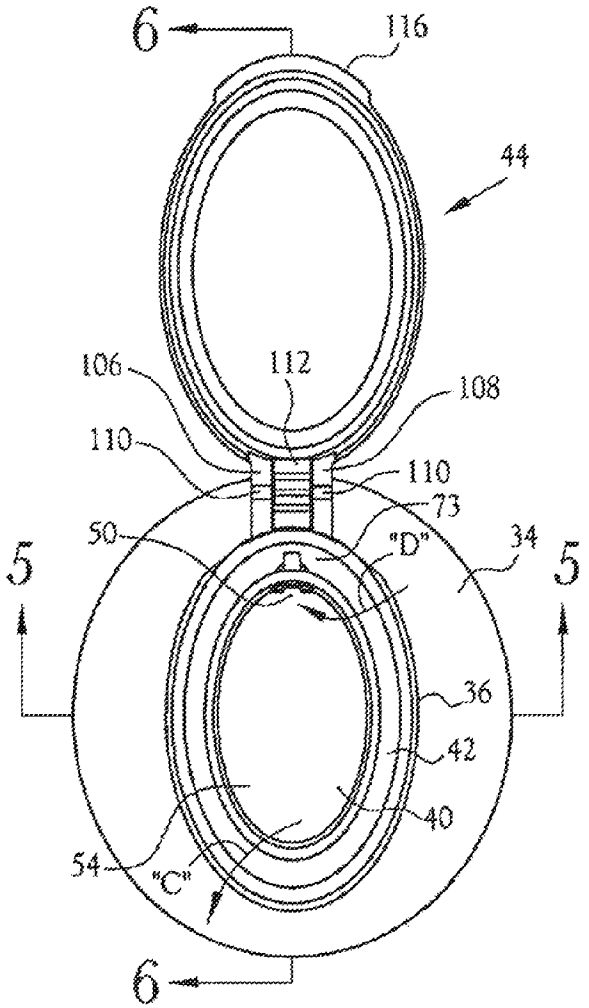
FIG. 4, is top plan view of the fitment of FIG. 3.

FIG. 2 depicts one embodiment of a fitment 26 embodying various of the features of the present invention. In this embodiment, the fitment includes a flat circumferential base flange 34, an upstanding wall 36 defining an open-ended conduit 38 providing fluid flow communication between the ambient environment and the interior of a container to which the fitment is affixed. In the embodiment depicted in FIG. 2, the conduit is closed by a tamper evident membrane 40 which extends across and closes the conduit 38 until such time as the membrane is removed as by a pull-ring 42. A cap 44 is hinged to the wall 36 for temporarily closing the conduit against material flow through the conduit, either into or out of the container after the membrane 40 has been removed.

Figure 6:
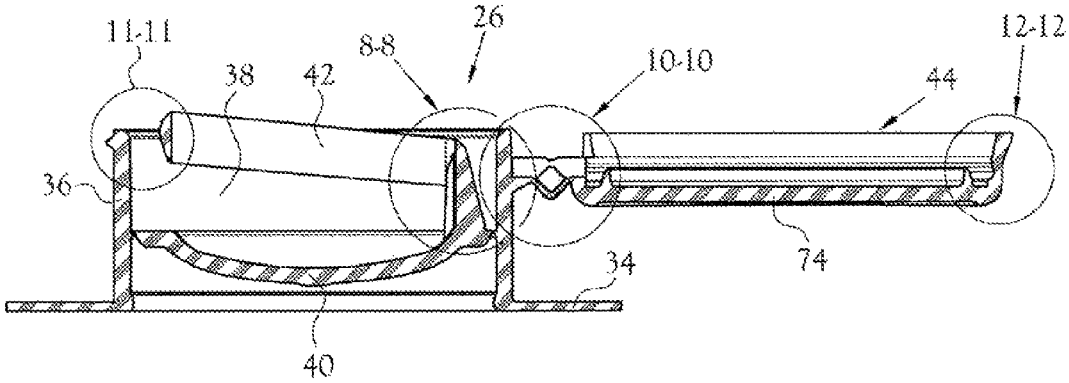
FIG. 6, is a side elevation view, in section, of the fitment depicted in FIG. 4 and taken generally along the line 6-6 of FIG. 4.
Figure 7:
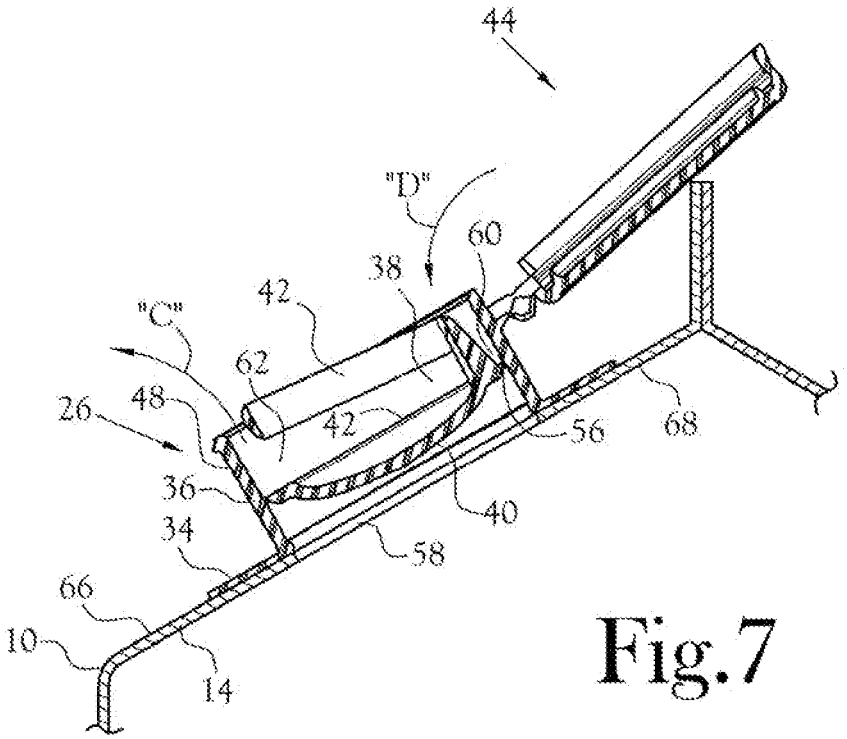
FIG. 7 is a side elevation view, in section, of a fitment of the present invention as affixed to a top panel of a gable top type container.
Figure 7A:
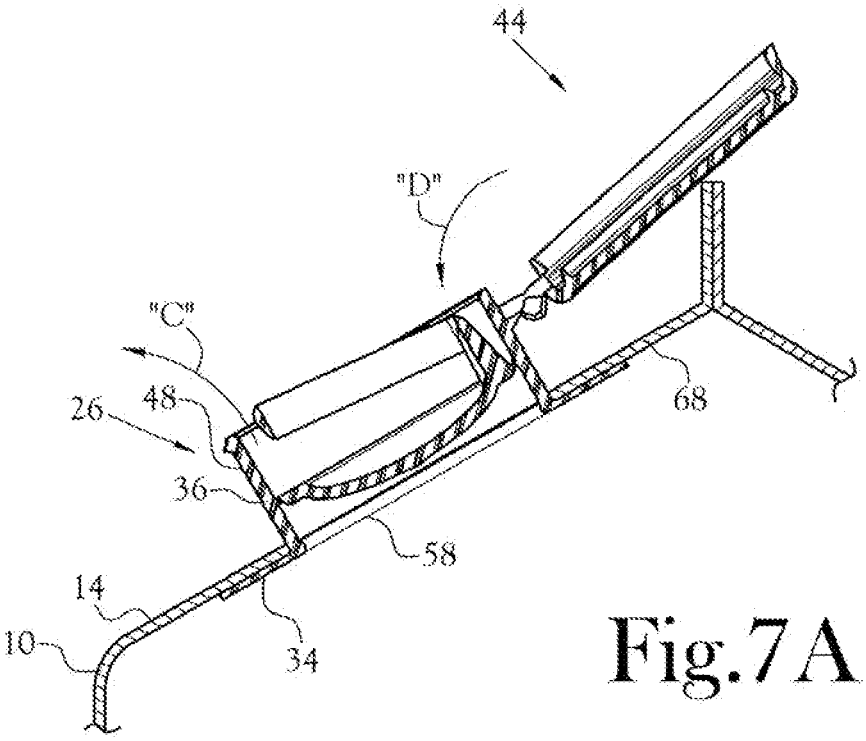
FIG. 7A is a side elevation view, in section, of a fitment of the present invention as affixed to the inner top of a gable top type container.

Referring to FIGS. 3-12, and initially FIG. 7, one embodiment of the present invention provides a fitment 26 comprising a flat circumferential flange 34 adapted to be bonded in leak-tight relationship to a panel 14 of a container 10 and covering an opening 58 defined through the thickness of the panel 14.

The embodiment depicted in FIGS. 3-12 is substantially the same as the embodiment depicted in FIG. 2 aside from the geometry of the conduit through which material, etc. exits or enters the container. Thus, like numerals are used to designate like components of these embodiments except where deemed more appropriate for understanding the invention.

In the depicted embodiment of FIGS. 3-12, the flange 34 of the fitment is adhesively bonded to the outer surface 66 of the panel 14 in overlying and covering relationship to the opening 58.

Whereas the base flange 34 is shown as being bonded to the outer surface 66 of the panel 14 of the container, it is more common to insert the fitment wall 38 through the opening 58 from the interior of the container so that the base flange 34 is bonded to the inner surface 68 of the panel 14.

As thus bonded to the top panel of the container, the fitment defines a pour spout for the discharge of the contents of the container therethrough. To this end, the present fitment includes a wall 36 upstanding from the flange 34 and which defines an open ended conduit 38 which, at one of its opposite ends 60 (entrance), (see FIG. 7) is in fluid flow communication through the opening 58 in the top panel to the interior of the container, and the other of its opposite ends 62 (exit) is open to ambient environment external of the container.

Figure 3:
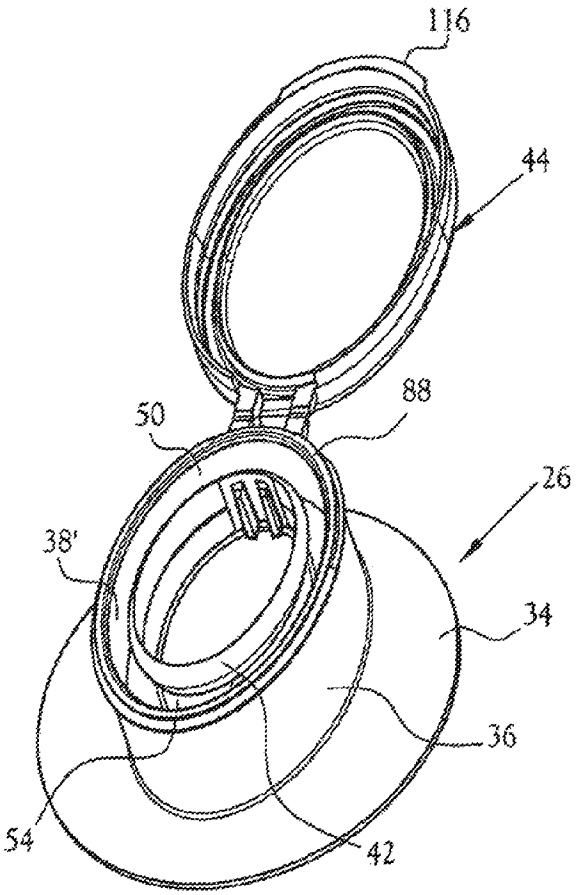
FIG. 3 is a representation of a further embodiment of a fitment embodying various of the features of the present invention.
Figure 5:
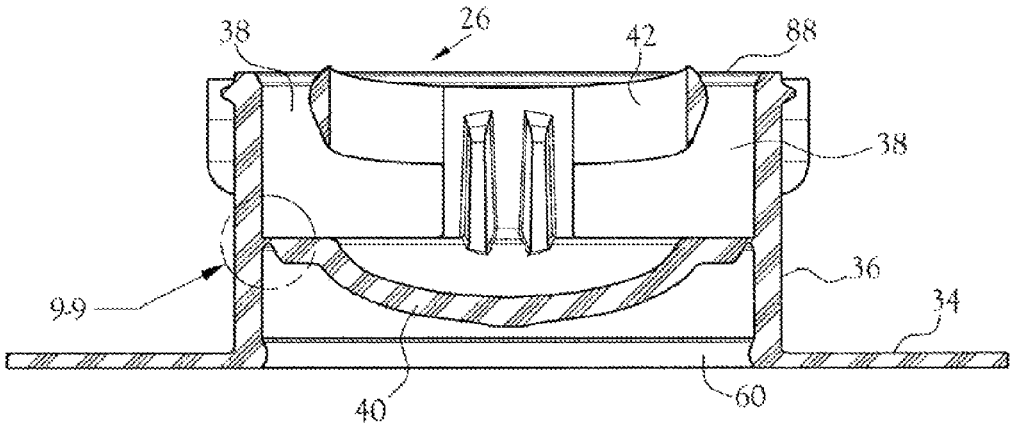
FIG. 5 is a side elevation view, in section, of the fitment depicted in FIG. 4 and taken generally along the line 5-5 of FIG. 4.
Figure 14:
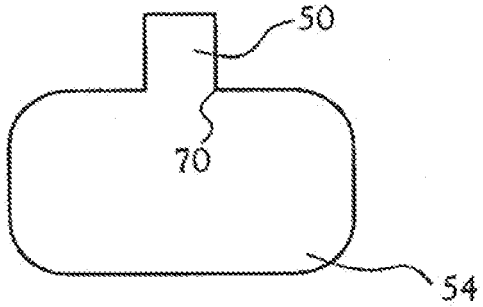
FIG. 14 is a plan view of another alternative embodiment of a geometrical shape of an opening through a fitment of the present invention.
Figure 15:
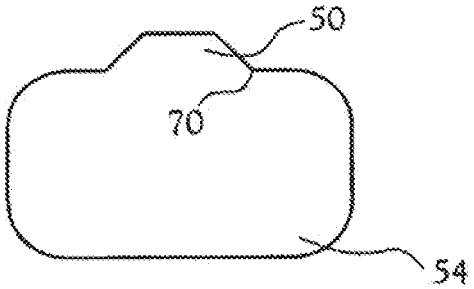
FIG. 15 is a plan view of another alternative embodiment of a geometrical shape of an opening through a fitment of the present invention.

Referring to FIGS. 2 and 3 specifically, constancy of uniform flow of contents from the container is effected by forming the exit end 62 of the conduit 38 with a generally ellipsoidal cross-sectional geometry. By "generally" it is meant that the planar cross-section of the exit end of the conduit 38 has at least one major portion 54 and at least one relatively minor and smaller portion 50, the at least one minor portion 50 being oriented vertically above the major portion when the fitment is affixed to the top end 12 of an upright container. In certain embodiments, the transition 70 (FIGS. 13-15, for example) between the major and minor portions is a continuous curve and in other embodiments, the transition may be a bend (for example see FIGS. 14 and 15) as depicted in FIGS. 14 and 15, or other combination of geometries (for example, see FIGS. 2, 4, 13-16). The definition includes a true ellipse (FIG. 4), a tear drop geometry (FIG. 2, and other geometries. FIGS. 2, 4, and 13-16 depict various geometries of the cross-section of the conduit exit opening which are deemed to be useful in the present invention. One skilled in the art will readily recognize other similar geometries for the opening which provide the desired functions of the opening as set forth herein.

In the embodiment depicted in FIG. 2, the ellipsoidal cross-sectional geometry of the conduit 38 defines a first (minor) portion 50 having an apex 52 and a second and larger (major) portion 54 having an apex 56. For present purposes, this relationship between the minor and major portions of the ellipsoidal cross-sectional geometry of the conduit 38 may be more specifically defined with reference to the aspect ratio of the geometry of the cross-sectional geometry of the conduit. Specifically, in the present invention, the aspect ratio (height "h" divided by width "w") of the cross-sectional geometry of the conduit 38 is greater than one (See FIG. 2), thereby distinguishing the geometry of the conduit of the present fitment from prior art circular conduits in fitments.

When the fitment of the present invention is affixed to an upright container (as depicted in FIG. 1 and in the top view of FIG. 2, the height (h) of the ellipsoidal geometry (depicted in FIG. 2), is aligned substantially coincident with the vertical centerplane 46 of the upright container 10. In a preferred embodiment, the height dimension of the ellipsoidal geometry of the present fitment is coincident with the vertical centerplane 46 of the container, but it will be recognized that the entire fitment may be moved laterally of the centerplane of the container either to the left or to the right as viewed in FIG. 2, thereby displacing the height dimension out of the centerplane of the container. Moreover, whereas it is preferred that the height dimension of the ellipsoidal geometry of the conduit of the present fitment be parallel to the centerplane of the container, whether coincident with or displaced laterally of, the centerplane, as also depicted in FIG. 2, the height dimension of the ellipsoidal geometry may be rotated to the left or right with respect to the centerplane of the container if desired. Angular deviation of the height dimension of the geometry, however, desirably is limited to not more than about 50 degrees either left or right from the centerplane of the container as depicted by angles "A" and "B" of FIG. 2.

In accordance with one aspect of the present invention, the geometry of the conduit, the location of the fitment being most vertically of the container to which the fitment is affixed, and the orientation of the fitment minor portion vertically above its major portion, provide for the outpouring (discharge) of the contents of the container primarily through that portion of the conduit defined by the major portion of the cross-sectional geometry of the conduit. Simultaneously, because the bulk, if not all, of the outpouring contents from the container pass through the major portion of the geometry, the minor portion of the geometry of the conduit remains open for the inflow of ambient air into the container to replace the volume of contents being poured out of the container. The flow of the contents out of the container and the flow of air into the container are depicted by the arrows "C" and "D", respectively, of FIGS. 4 and 7. By reason of this feature of the present invention, the present inventor provides for elimination or at least substantial reduction of the prior art problem of "burping" and resultant erratic flow of contents from the container and the myriad of undesirable results of such erratic flow. Contrariwise, the flow of contents from a container having a fitment of the present invention associated therewith is constant and smooth, providing a well-controlled and even-volume stream of contents exiting the container through the conduit. Moreover, because the present invention provides a relatively large pathway for the flow of ambient air into the container, it has been found that the contents of the container can be more rapidly discharged, all without the undesirable aspects of the prior art fitments.

The cross-sectional geometry of the opening 40 (FIG. 7) through the top panel of the container preferably is of substantially the same size and geometry as the cross-sectional geometry of the conduit 38 defined by the wall of the fitment of the present invention, but such opening 40 may assume other geometries.

The wall 36 upstanding from the flange 34 defines a conduit 38 through which the contents of the container may be poured (discharged). Preferably, the cross-sectional area of the conduit defined by the wall 36 is substantially constant over substantially the entire length of the conduit, but it is acceptable for the cross-sectional area of the conduit to vary along the length of the conduit by an amount which is insufficient to adversely affect the desired outflow of the container contents as described herein. For example, the cross-sectional area of the conduit at its entrance end 60 may be larger, but preferably not smaller, than the cross-sectional area of the conduit at its outboard exit opening 62.

Figure 8:
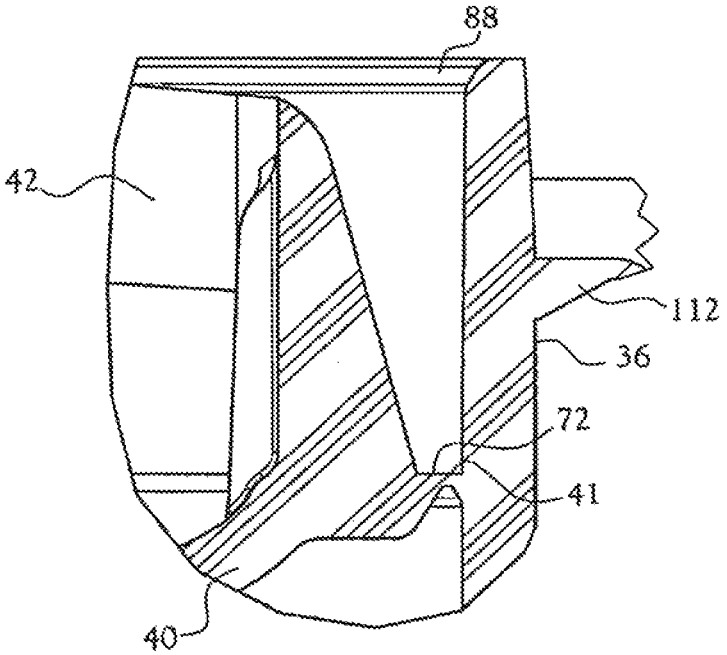
FIG. 8 is detail view, in section, of that portion of the fitment depicted in FIG. 6 taken generally along the line 8-8 of FIG. 6.
Figure 9:
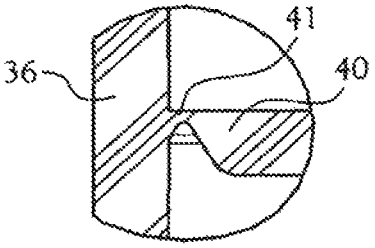
FIG. 9 is a detailed view, in section, of that portion of the fitment depicted in FIG. 5 in section, taken generally along the line 9-9 of FIG. 5.

Preferably, internally of the conduit 38 there is provided a tear away membrane 40 having its perimeter 41 integrally formed with the wall 36 (see also FIGS. 8 and 9). A finger pull ring 42 substantially like the pull rings of the prior art, is attached to the membrane at a location 72 along the perimeter 41 of the membrane whereby insertion of a finger into the ring and applying a pulling force up and outwardly of the conduit, ruptures the membrane 40 initially at the location 72, and further application of a pulling force to the ring effects full tearing away of the membrane from the wall 36, thereby opening the conduit 38 for the passage of the contents of the container out of the container. Thus, the membrane/pull ring combination serves as a tamper evident component of the fitment. in a preferred embodiment, the pull ring is attached to the membrane only at the most vertical portion 73 of the minor portion 50 of the cross-sectional geometry of the conduit (see FIG. 4).

As noted, in accordance with one aspect of the present invention, the point of initiation 72 (FIG. 8) of the tearing away of the membrane of the present fitment preferably is selected to be coincident with the minor portion 50 of the opening geometry, preferably the most vertical portion of the minor portion. Thus, it is preferred that the geometry of the present fitment include a minor portion which relatively smoothly transitions into the major portion, thereby minimizing the required increase in the force required to tear away the membrane as the tear proceeds along the perimeter of the membrane in a direction away from the minor portion.

The fitment of the present invention further includes a cap 44 useful for closing the conduit 38 of the fitment as may be desired to preserve contents of the container which may desirably be allowed to remain in the container, for later use, for example. The cap of the present fitment includes a generally planar top 74 having an inner surface 76 which faces the outboard rim 88 of the wall 36 when the cap is in a closed position. As seen in FIG. 6, an outer wall 80 extends outwardly from the inner surface 76 of the cap top 74 at a location adjacent to and along the outer perimeter 82 of the top. Radially inwardly of the outer wall 80 there is provided an inner wall 84 which also projects outwardly from the inner surface 76 of the top of the cap, such inner wall being concentric with, but spaced radially inwardly of, the outer wall 80 to define a void annular space 86 therebetween. The material of choice for the fitment, hence the cap and its walls, is a polymeric material, such as LDPE, which is sufficiently flexible and resilient as will permit the outer rim 88 of the wall 36 of the conduit (see FIG. 12) to be received within the annular space 80 defined by the double walls of the cap, to releasably close and seal the conduit. As desired, the outer rim 88 of the wall 36 may be provided with a circumferential projection 90 which may be frictionally snapped into a corresponding circumferential groove 92 defined in the outer wall 80 of the cap.

Figure 16:
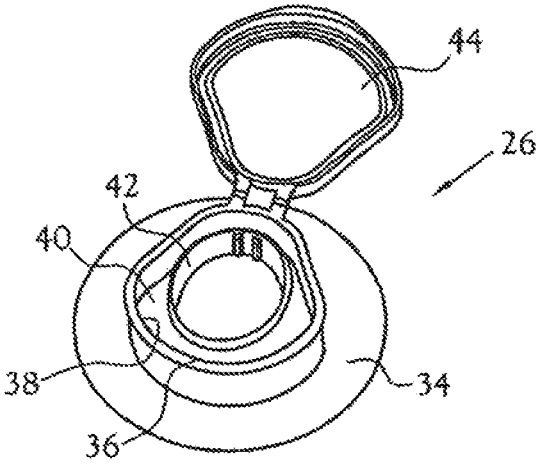
FIG. 16 is a schematic representation of another alternative embodiment of a fitment of the present invention.
Figure 17:
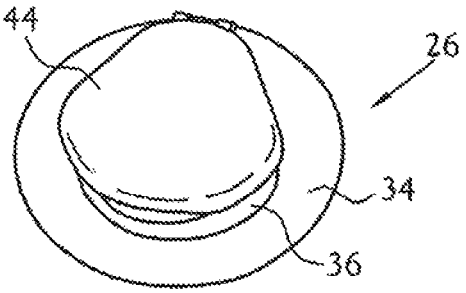
FIG. 17 is a representation of the fitment depicted in FIG. 16 with its lid closed; and, FIG. 18 is a representation of the right-hand side, of the fitment depicted in FIG. 17.
Figure 18:
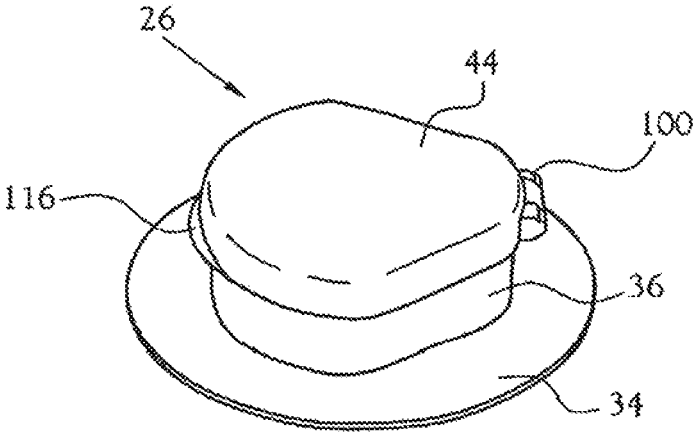

The embodiment of FIG. 16 depicts the fitment in its "open" attitude, that is, with the cover hinged open. In FIG. 16, the tamper resistant seal and its accompanying pull ring are depicted in their sealing attitude with respect to the conduit 50. In FIG. 17, the fitment is depicted with the cap in its closed attitude. FIG. 18 depicts a side perspective view of the embodiment of FIG. 17.

Figure 10:
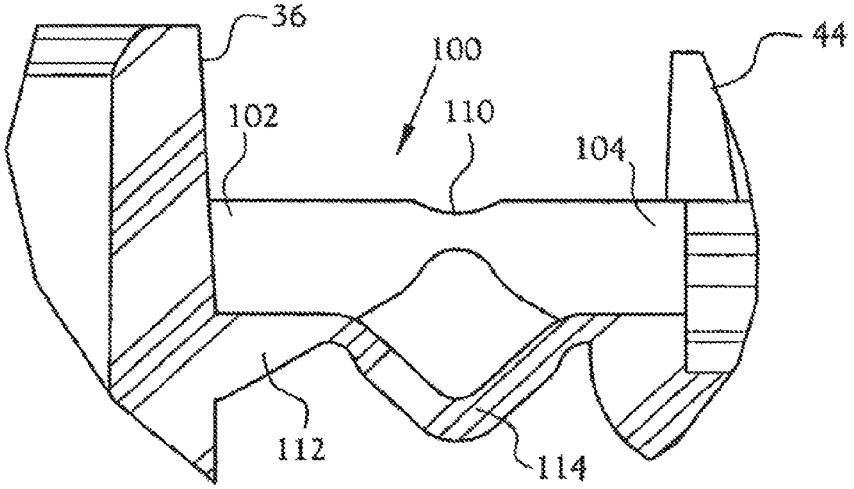
FIG. 10 is a detailed view, in section, of that portion of the fitment depicted in FIG. 6, taken generally along line 10-10 of FIG. 6.
Figure 11:
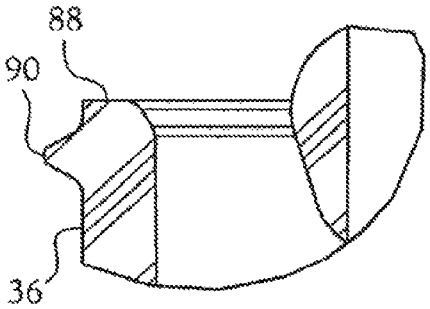
FIG. 11 is a detailed view, in section, of that portion of the fitment depicted in FIG. 6 taken generally along line 11-11 of FIG. 6.
Figure 12:
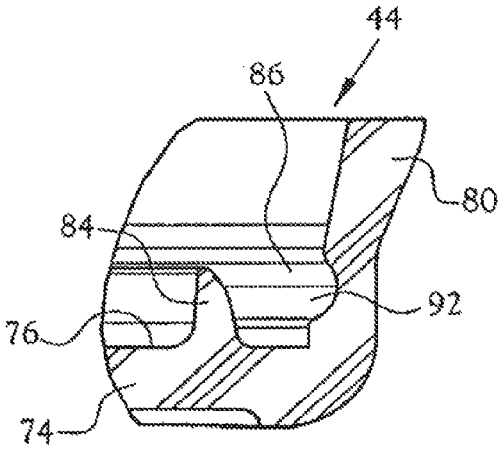
FIG. 12 is a detailed view, in section, of that portion of the fitment depicted in FIG. 6, taken generally along line 12-12 of FIG. 6.
Figure 13:
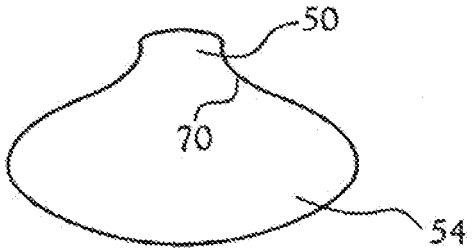
FIG. 13 is a plan view of an alternative embodiment of a geometrical shape of an opening through a fitment of the present invention.

With reference to several of the Figures, especially FIG. 10, the cap of the present fitment is integrally formed with the wall 36 of the fitment. In the depicted embodiment, the joinder between the cap and the base element is in the form of a hinge 100, one end 102 of which is integrally formed with the wall 36 and the opposite end 104 of which is integrally formed with the outer wall 80 of the cap. The depicted hinge includes three elements comprising first and second elongated elements 106, 108 respectively, each of which is provided with a reduced thickness 110 generally centrally of the length thereof and a third element 112 which is integrally formed with the first and second elements and includes a central portion 114 which expands from a folded configuration centrally thereof to aid in retention of the cap in its open position, but which permits the cap to hinge to its closed position. It will be recognized by one skilled in the art that other configurations of the cap and the perimetral rim of the wall of the base component may be employed for releasably closing the conduit with the cap.

The present invention further includes a method for controlling the constancy of discharge of pourable contents of a container fitted with a pour spout associated with a top end wall of the container comprising the steps of establishing a open ended conduit between the interior and the exterior of the container, defining a cross-sectional geometry for the conduit, the cross-sectional geometry including at least a major portion and at least a smaller minor portion, and affixing the pour spout to the container with the minor portion of the cross-sectional geometry disposed vertically above the major portion of the cross-sectional geometry, whereby the contents of the container are preferentially discharged from the container through the at least one major portion and ambient air substantially simultaneously enters the container through the at least one minor portion of the geometry.

What is claimed:

1. A fitment for a container having a top end and a first wall associated with the top end and an opening extending through the thickness of the first wall, the fitment comprising:

a circumferential flange member adapted to engage the first wall of the container in circumscribing relationship to the opening through the top wall for mounting of the fitment to the container, the flange member defining a first plane adjacent to the opening;

a second wall upstanding from the flange member and defining a conduit having an inner wall and entrance and exit ends through which contents of the container may be discharged, the exit end defining a second plane, the second wall having a circumferential projection extending radially therefrom adjacent to the exit end;

at least the exit end of the conduit having a substantially ellipsoidal planar cross-sectional geometry having a major portion and a minor portion, wherein the ellipsoidal planar cross-sectional geometry has a height-to-width aspect ratio greater than 1;

the minor portion being disposed vertically above the major portion when the fitment is affixed to the first wall of the container and the container is oriented in a direction for discharge of the contents of the container through the opening and substantially simultaneous ingress of ambient air into the container through the minor portion of the fitment;

a tear away membrane with a tamper evident membrane portion disposed across and releasably engaging the inner wall of the conduit at a location fully within the conduit, the conduit having a substantially constant cross-sectional area between the entrance and exit ends, wherein the first wall associated with the top end of the container will be in a third plane between the membrane portion and the flange member, and the membrane portion having a perimeter releasably joined to the inner wall of the conduit in a fourth plane spaced apart from the flange member and positioned between the second and third planes, whereby the membrane portion closes the conduit, the tear away membrane including a pull ring affixed to the membrane portion adjacent to the minor portion of the conduit and configured to provide for localization of an initial tear away force applied through the pull ring to the tamper evident membrane portion adjacent to the minor portion of the conduit; and a cap member integrally attached in hinged relationship with the second wall defining the conduit adjacent to the exit end of the conduit and adjacent to the minor portion, the cap having an annular receiving area between first and second annular projections extending away from a cap top wall, one of the first or second annular projections having a circumferential groove that receives therein the circumferential projection of the second wall when the cap is in a closed position covering the exit end, the annular receiving area configured to receive therein in a sealing engagement an outboard rim of the second wall to thereby releasably close and seal the conduit against the passage of the contents of the container therethrough, and wherein the first annular projection of the cap member is radially outward of the second annular projection, and the cap member has a hinge member integrally connected to the first annular projection at the top cap wall and integrally connected to the second wall defining the conduit, the first annular projection having an opening therein immediately adjacent to the hinge member and configured to receive a portion of the hinge member therein when the cap is in the closed position and in sealable engagement with the exit end of the second wall.

2. The fitment of claim 1 wherein the circumferential flange is configured to be disposed internally of the container and affixed to the inner surface of the first wall associated with the top end of the container, and the second wall is configured to extend outwardly from the opening to define the conduit.

3. The fitment of claim 2 wherein the second wall upstanding from the circumferential flange member projects from the circumferential flange through the opening defined through the first wall associated with the top end of the container.

4. The fitment of claim 1 wherein the fitment is a one-piece fitment with the second wall, the tear away membrane and the cap integrally connected to each other.

5. The fitment of claim 1 wherein the cap member is integrally connected to the second wall defining the conduit by the hinge member, wherein the hinge member has first and second elongated elements integrally connected to the cap top wall and having an intermediate portion with a reduced thickness, and a third element integrally connected with the first and second elements and having a central portion movable between a folded position and a first open position, the central portion configured to aid in retaining the cap in a second open position while allowing the cap member to pivot via the first and second elongated elements to the closed position in sealable engagement with the outboard rim of the second wall.

6. A fitment and container assembly, comprising:

a container having a top end and a first wall associated with the top end and an opening extending through the thickness of the first wall, the opening having an ellipsoidal shape;

a circumferential flange member adapted to engage the first wall of the container in circumscribing relationship to the opening, the flange member defining a first plane;

a second wall extending from the flange member and defining a conduit having an inner wall and entrance and exit ends, the exit end defining a second plane spaced apart from the first plane, the conduit having a substantially constant cross-sectional area between the entrance and exit ends, the conduit having a substantially ellipsoidal planar cross-sectional geometry substantially corresponding to the ellipsoidal shape of the opening and having a major portion and a minor portion with a height-to-width aspect ratio greater than 1;

the minor portion being disposed vertically above the major portion when the fitment is affixed to the first wall of the container and the container is oriented in a direction for discharge of the contents of the container through the opening and substantially simultaneous ingress of ambient air into the container through the minor portion of the fitment;

a tear away membrane with a tamper evident membrane portion extending across the conduit and having a perimeter releasably joined to the inner wall of the conduit at a position defining a third plane located between the first and second planes and spaced away from the opening, the tear away membrane closes the conduit, and the tear away membrane including a pull ring affixed to the membrane portion adjacent to the minor portion of the conduit and configured to provide for localization of an initial tear away force applied through the pull ring to the tamper evident membrane portion adjacent to the minor portion of the conduit to reduce the force needed for initiation of tearing away of the tamper evident membrane portion from the inner wall of the conduit; and a cap integrally connected to the second wall at a position adjacent to the exit end of the conduit and adjacent to the minor portion, the cap having an ellipsoidal shape substantially corresponding to the ellipsoidal planar cross-sectional geometry of the conduit and configured to pivot relative to the conduit between open and closed positions, the cap having an annular receiving area between first and second annular projections extending away from a cap top wall and having a hinge member with first and second elongated elements having an intermediate portion with a reduced thickness, and a third element integrally connected with the first and second elements and having a central portion movable between a folded position and a first open position, the central portion configured to aid in retaining the cap in a second open position while allowing the cap member to pivot via the first and second elongated elements to the closed position in sealable engagement with the second wall, and wherein the first annular projection of the cap member is radially outward of the second annular projection, and hinge member integrally connected to the first second wall defining the conduit, the first annular projection having an opening therein immediately adjacent to the hinge member and configured to receive a portion of the hinge member therein when the cap is in the closed position and in sealable engagement with the exit end of the second wall.

7. The assembly of claim 6 wherein the annular receiving area receives therein in a sealing engagement an outboard rim of the conduit when the cap is in the closed positon thereby releasably closing and sealing the conduit against the passage of the contents of the container therethrough.

8. The assembly of claim 6 wherein the container and the fitment each includes a longitudinal centerplane and the centerplanes are coincident.

9. The assembly of claim 6 wherein the circumferential flange is physically disposed internally of the container and affixed to an inner surface of the first wall associated with the top end of the container and the conduit extends orthogonally from a circumferential margin of the opening outwardly of the opening.

10. The fitment of claim 6 wherein the membrane portion and the pull ring are substantially disposed within the conduit and at a location within the conduit spaced apart from the opening.

11. The fitment of claim 6 wherein the fitment is a one-piece fitment with the conduit, the tear away membrane and the cap being integrally connected to each other.

12. A fitment and container assembly, comprising:

a container having a top end and a first wall associated with the top end and an opening extending through the thickness of the first wall, the opening having an ellipsoidal shape;

a circumferential flange member affixed to the first wall around the opening, the flange member defining a first plane;

a conduit extending from the flange member and having an inner wall and entrance and exit ends, the exit end defining a second plane spaced apart from the first plane, the conduit having a substantially ellipsoidal planar cross-sectional geometry substantially corresponding to the ellipsoidal shape of the opening and having a major portion and a minor portion with a height-to-width aspect ratio greater than 1;

the minor portion being disposed vertically above the major portion when the container is oriented in a direction for discharge of contents of the container through the opening and substantially simultaneous ingress of ambient air into the container through the minor portion of the fitment;

a cap integrally connected to the conduit adjacent to the exit end and adjacent to the minor portion, the cap being pivotable relative to the conduit between open and closed positions, the cap having a hinge member with first and second elongated elements integrally connected to the conduit, and a third element integrally connected with the first and second elements and having a central portion movable between a folded position and a first open position, the central portion configured to aid in retaining the cap in a second open position while allowing the cap member to pivot via the first and second elongated elements to the closed position in sealable engagement with an outboard rim of the conduit, the cap having first and second annular projections extending from a surface thereof, the first annular projection being radially outward of the second annular projection defining an annular receiving area, the exit end of the conduit disposed in the annular receiving area when the cap is in the closed position, and the hinge member is integrally connected to the first annualr projection at a cap top wall, the first annular projection having an opening therein immediately adjacent to the hinge member and configured to receive a portion of the hinge member therein when the cap is in the closed position and in sealable engagement with the exit end of the conduit; and a tear away membrane in the conduit and covered by the cap when the cap is in the closed position, the tear away membrane having a tamper evident membrane portion extending across the conduit and having a perimeter releasably joined to the inner wall of the conduit at a position defining a third plane located between the first and second planes and spaced away from the opening, the tear away membrane closes the conduit, and the tear away membrane including a pull ring affixed to the membrane portion adjacent to the minor portion of the conduit and configured to provide for localization of an initial tear away force applied through the pull ring to the tamper evident membrane portion adjacent to the minor portion of the conduit to reduce the force needed for initiation of tearing away of the tamper evident membrane portion from the inner wall of the conduit.

13. The assembly of claim 12 wherein the container and the fitment each includes a longitudinal centerplane and the centerplanes are coincident.

14. The assembly of claim 12 wherein the circumferential flange is physically disposed internally of the container and affixed to an inner surface of the first wall associated with the top end of the container and the conduit extends orthogonally from a circumferential margin of the opening outwardly of the opening.

15. The fitment of claim 12 wherein the fitment is a one-piece fitment with the conduit, the tear away membrane and the cap being integrally connected to each other.

* * * * *